United States Patent [19]

Winter et al.

[11] 4,015,459

[45] Apr. 5, 1977

[54] HYDRODYNAMIC DRAWING OF MULTIPLE GAUGE METAL STRIP

[75] Inventors: Joseph Winter, New Haven; Eugene Shapiro, Hamden; Warren F. Smith, Branford, all of Conn.

[73] Assignee: Olin Corporation, New Haven, Conn.

[22] Filed: Dec. 31, 1975

[21] Appl. No.: 645,749

Related U.S. Application Data

[63] Continuation-in-part of Ser. No. 462,755, April 22, 1974, abandoned.

[52] U.S. Cl. ..... 72/45; 72/60; 72/274; 72/467

[51] Int. Cl.[2] ..... B21C 3/10

[58] Field of Search ..... 72/41, 45, 60, 274, 72/275, 467, 468

[56] References Cited

UNITED STATES PATENTS

| | | | |
|---|---|---|---|
| 627,558 | 6/1899 | White | 72/274 |
| 3,526,115 | 9/1970 | Armstrong et al. | 72/467 |
| 3,740,990 | 6/1973 | Prajsnar et al. | 72/467 |
| 3,782,164 | 1/1974 | Felker | 72/467 |

*Primary Examiner*—Lowell A. Larson
*Attorney, Agent, or Firm*—Robert H. Bachman; Robert A. Dawson

[57] ABSTRACT

Multiple gauge metal strip is prepared by a process which comprises shaping strip material of rectangular cross section to form regions of at least two variable thicknesses defining a stepped surface configuration in at least one of the broad surfaces of said strip, and drawing the shaped strip through a die which defines said cross sectional configuration to produce a reduction of said strip to final dimension, wherein said drawing step is performed without direct surface-to-surface contact between said strip and said die, such that the width dimension of said strip is unchanged and the ratio of strip surface to strip cross sectional area changes by at least 30%. The drawing method of this invention employs hydrodynamic lubrication and can achieve one-pass cross sectional reductions of from 39 to 55%.

24 Claims, 5 Drawing Figures

HYDRODYNAMIC DRAWING OF MULTIPLE GAUGE METAL STRIP

CROSS REFERENCE TO RELATED APPLICATION

The present application is a Continuation-In-Part of co-pending application Ser. No. 462,755, filed on Apr. 22, 1974, now abandoned, by the inventors herein.

BACKGROUND OF THE INVENTION

The invention relates to a method and apparatus useful for the preparation of multiple gauge metal strip of exacting tolerance by a drawing operation employing hydrodynamic lubrication.

In many applications, such as the production of copper strip for the formation of electrical connectors and the like, it is necessary to provide a multiple gauge thickness in the metal strip. Heretofore, such conventional procedures as continuous milling and continuous shaving have been employed to produce the desired variations in gauge. Such processes suffer from the disadvantages of being both highly scrap intensive and in the case of milling time-consuming.

Another procedure which has been investigated in the art is the reduction to gauge by a rolling operation. Rolling operations in production are normally only accurate to about 10% and are not good enough to provide products meeting commercial tolerances that are free from structural defects such as camber, edge waves, buckling or longitudinal cracking. One method of rolling which has been successfully developed is disclosed by Applicants in copending application Ser. No. 439,519, entitled "METHOD FOR PRODUCING MULTIPLE GAUGE STRIP", now Pat. No. 3,866,451, and deals with a technique known as grooved rolling wherein strip reduction is confined to the area of contact with the grooves of the roll assembly.

In addition to the techniques outlined above, examination has been made of drawing techniques with appropriately configured dies. Generally, the preparation of a multiple gauge product by drawing results in complications caused by conventional metal flow. That is, in the normal drawing process, reduction of the thickness in a section results in an increase in section length, so that if the thickness of a given shape varies across its width, the drawing process will result in variable changes in length causing non-uniform metal flow and stresses leading to buckling, twisting, tearing and fracture of the workpiece. Though a wide variety of drawing techniques are known, including the employment of the hydrodynamic principle, none have been suggested or would appear to alleviate the aforenoted deficiencies associated with the drawing of complex multiple gauge configurations.

SUMMARY OF THE INVENTION

In accordance with the present invention, it has been found that a drawing operation may be employed for the preparation of multiple gauge metal strip meeting close tolerance requirements which comprises drawing a previously shaped strip through a die defining the desired cross sectional configuration wherein direct surface-to-surface contact between the strip and the die is prevented, the width dimension of the strip is unchanged and the ratio of strip surface to strip cross sectional area changes by at least 30%. The drawing operation employed herein utilizes hydrodynamic lubrication and enables the achievement of one pass reductions ranging from 39 to 55% of strip cross sectional area.

An apparatus employed in the drawing operation of this invention is also disclosed which comprises a container housing a quantity of lubricant material and possessing openings in its side walls enabling the entry and exit of the strip workpiece, and a die assembly mounted adjacent the container in communication with one of the openings which comprises a hydrodynamic section and a reduction section connected thereto.

The strip material processed by the drawing operation of this invention is generally previously shaped to the approximate configuration desired in the final article. Previous shaping may be conducted by a wide variety of processes including milling and shaving. In a preferred embodiment, the strip is shaved by a process disclosed in our co-pending application Ser. No. 642,594, filed Dec. 19, 1975, commonly assigned.

The method of this invention possesses the advantages of generating little or no scrap and of greatly reducing the time and energy necessary to manufacture the various multiple gauge products. The reduction in frictional forces achieved by the method of this invention permits greater reductions to be taken without the likelihood of either distortion or fracture of strip which would occur with a conventional drawing operation. The die assembly forming a part of the apparatus of this invention is easily adaptable to rapid changes in the size and/or shape of product desired by the substitution of interchangeable components. The products thus produced possess unexpectedly improved dimensional precision, and are free from structural defects such as strip curvature, buckling and fracture.

Accordingly, it is a principal object of this invention to provide an improved method for the manufacture of multiple gauge metal strip which yields products possessing improved dimensional precision and freedom from structural defects.

It is another object of this invention to provide a method aforesaid which generates little or no scrap and which achieves greater strip reduction within a reduced production time.

It is a further object of this invention to provide a method as aforesaid which comprises a drawing operation which is performed without direct surface-to-surface contact between the strip and the die.

It is yet a further object of this invention to provide an apparatus for use in the practice of the method as aforesaid which is rapidly and easily adaptable to changes of size and/or shape of the desired product.

It is still a further object of this invention to provide a method as aforesaid which may be practiced utilizing a single pass procedure.

Other objects and advantages will become more apparent to those skilled in the art as a detailed description follows with reference to the drawings.

DETAILED DESCRIPTION

Figure 1:
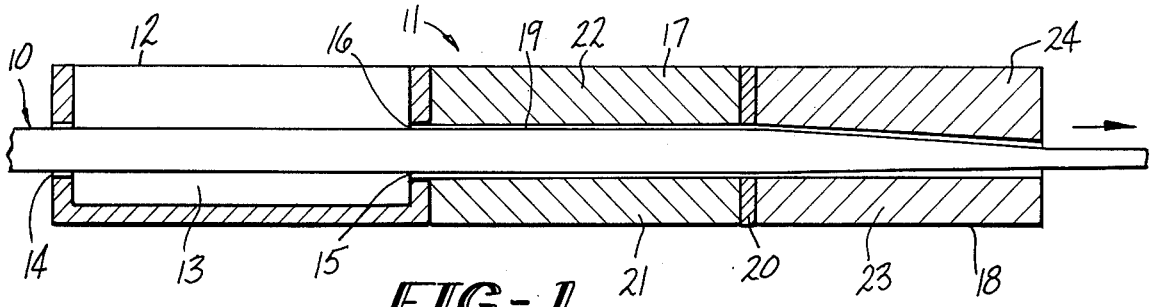
FIG. 1 is a cross sectional schematic view of a multiple gauge strip passing through the drawing apparatus of this invention.

In accordance with the present invention, a method and associated apparatus for the preparation of multiple gauge metal strip of exacting tolerance is presented which employs a drawing operation utilizing hydrodynamic lubrication wherein direct surface-to-surface contact between the strip and the drawing die is prevented.

The method of the present invention comprises drawing a previously shaped strip through a drawing die of corresponding multiple gauge configuration, wherein in addition to the absence of said surface-to-surface contact, the width dimension of the strip is unchanged and the ratio of strip surface to strip cross sectional area changes by at least 30%, and preferably from 30 to 50%. The method of this invention employs hydrodynamic lubrication which facilitates the achievement of one pass cross sectional reductions ranging from 39 to 55% thickness.

As was noted earlier, attempts to produce products possessing multiple gauge configurations have met with little success, as the uneveness of metal flow occasioned by the variation in thickness of a given shape has resulted in non-uniform metal flow and stress resulting in buckling, twisting and fracture of the workpiece. Accordingly, multiple gauge configurations feasible for preparation by a drawing process were relatively few and were generally confined to simple geometrical shapes such as wedges, trapezoids and the like. U.S. Pat. No. 627,558 to White and British Pat. Specification No. 563,820 to Bolton et al. are representative of such configurations which were apparently prepared by drawing. When the preparation of a thin strip product possessing a multiple guage configuration comprising regions of at least two variable thicknessess defining a stepped surface and configurations of like complexity were attempted, the aforenoted difficulties were encountered and the employment of drawing was determined to be commercially unfavorable. A particular reason for this lay in the substantial surface to cross sectional area ratios involved in the preparation of strip of such configuration, particularly for products having contemporary application in the electronics industry. Thus, when strip possessing such large surface to cross sectional area ratios is drawn, the frictional forces which are a function of surface contact with the die are prohibitively high and require a drawing force which tends to exceed the ability of the strip to maintain its integrity. Particularly in respect to the present invention, the surface to cross sectional area ratio becomes quite large, as the strip product undergoes no reduction of the width dimension, while the change in cross sectional area of the strip may range up to 55%. Clearly the resultant thinning out of the strip by the drawing operation reduces its ability to sustain the drawing force necessary to overcome the friction resulting from the almost constant surface area. Clearly neither the recognition of this problem nor its solution with respect to the shape encompassed herein is recognized by either of the aforementioned disclosures.

Accordingly, it has been unexpectedly found that a drawing operation may be conducted on a previously shaped strip wherein cross sectional reductions on the order of 39 to 55% in one pass may be achieved without either direct surface-to-surface contact between strip and die, or a change in the width dimension of the strip produced. This latter feature is believed significant, as conventional drawing operations generally result in a change in the width dimension of the workpiece, whether in reduction or expansion due to metal flow. In the instance where reduction of the width is conducted uniformly and in relation to the reduction in thickness, the aforementioned surface to cross sectional area ratio tends to remain constant, and drawing forces are accordingly reduced in proportion to the strength of the strip at the reduced thickness. By contrast, it must be emphasized that the present invention results in an increase in said surface to area ratio as non-uniform strip reduction is conducted wherein the width dimension is unchanged by drawing. Applicants attribute the operability of the method of the present invention in part to the provision of hydrodynamic lubrication at the drawing die, particularly in view of the fact that the nature of the non-uniform reduction being taken herein tends to place greater strain on the workpiece. An additional feature contributing to the successful operation of the present method comprises the configuration of the drawing die located in the reduction section of the apparatus of the present invention. Specifically, the surfaces of said die which define the areas of differing gauge are inclined at individually determined angles which serve to provide equal percentage reductions in strip height over the entire section of the strip at any transverse plane section observed within the deformation zone. The above features will be discussed in greater detail hereinbelow.

As noted earlier, the method of the present invention features the employment of hydrodynamic lubrication. The essential feature of hydrodynamic lubrication which distinguishes it from thin film or boundary lubrication utilized in conventional drawing is that the lubricant film is sufficiently thick to prevent contact between the deforming metal and the drawing die.

The method of this invention is illustrated in FIG. 1 which schematically depicts a multiple gauge metal strip 10 passing through the drawing apparatus 11 of this invention. The strip first passes through a container 12 which houses a quantity of lubricant 13 sufficient to completely cover the strip. Passage through container 12 is afforded by openings 14 and 15, respectively, which are in linear alignment with the entrance 16 to the hydrodynamic section 17. The strip then enters hydrodynamic section 17 bearing on its surface lubricant 13 picked up during its passage through container 12.

Hydrodynamic section 17 comprises an adjustable inlet nozzle defining a cross sectional area of a size sufficient to enable the passage of lubricant-coated strip 10. As strip 10 passes through hydrodynamic section 17, the lubricant picked up by the moving workpiece is compressed and exerts a substantial pressure on the strip. The lubricant pressure which develops in the reduction section 18 must be sufficient to cause the desired shape change dictated by the die configuration without permitting surface-to-surface contact between the die and the strip. The determination of the lubricant pressure is governed by several factors, such as lubricant viscosity, inlet nozzle length, drawing speed, clearance between the strip and nozzle and flow rate of lubricant through the reduction section. These factors can be varied to produce the required pressure to provide the desired cross sectional reduction of the strip and will be discussed in greater detail hereinafter.

The moving strip under lubricant pressure passes from hydrodynamic section 17 to reduction section 18, where it is drawn into the final product. Reduction section 18 comprises a drawing die which defines a multiple gauge configuration. As stated above, drawing is accomplished without surface-to-surface contact between the die and strip 10, as well as no change in the width of strip 10 issuing from reduction section 18. The multiple gauge product which exits from reduction section 18 may be easily varied in cross sectional shape by the substitution of differently shaped die components. Also, because of the large reduction in the frictional component of the drawing force which is afforded by the employment of hydrodynamic lubrication, the drawing process of this invention is conducted in less time and with the achievement of greater reductions per pass.

As stated earlier, hydrodynamic lubrication provides a lubricant pressure sufficient to enable drawing of the strip to occur without surface-to-surface contact between the strip and the die. Several factors govern the determination of proper lubrication pressure and deserve some consideration.

The first of these factors is lubricant viscosity. Lubricant viscosity is dependent upon the nature of the lubricant chosen. The lubricant materials which may be used in the method of this invention comprise the conventional drawing oils and drawing soaps. It has been found, however, that drawing soaps are more favorable as they possess a significantly higher viscosity. This greater viscosity overcomes certain intrinsic difficulties, among them lubricant leakage and build up of sufficient pressure. Thus, die fabrication is made simpler as sealing abilities of the components is less critical. Likewise, other factors which are influenced by lubricant viscosity are the length of the inlet nozzle and the clearance between the strip and the nozzle. Thus, if a lubricant is employed which possesses a higher viscosity, the nozzle length may be decreased and the clearance 19, as depicted in FIG. 1, may be increased. An advantage of the latter is that the tolerance requirements for the incoming strip may be relaxed, as the clearance is less restrictive.

Other factors which influence lubricant pressure, such as drawing speed and flow rate of lubricant through the reduction section are positively correlated with optimum pressure. Thus, increased drawing speed carries with it an increased flow rate of lubricant, and both tend to increase the pressure exerted on the incoming strip.

As noted earlier, another feature of the method of this invention resides in the design of the reduction section. Certain dimensional criteria were determined to be important in order to ensure straight exiting of the strip without buckling. These criteria are as follows:

1. The same volume of material must exit the die as enters the die.

2. There must be equal percentage reductions in height over the entire cross section of the strip and reductions must occur uniformly in any transverse plane section through the deformation zone. That is, if a transverse section were to be observed at any point along the deformation zone, the percentage reduction across the entire section of the strip, including all variant gauge sections, should be equal. In accordance with this requirement, the surfaces of the die which define the variation in gauge must be disposed at slightly different angles with respect to each other, as well as to the longitudinal direction of the strip workpiece. This particular aspect of the invention will be illustrated by the description of the drawing die in Experiment I, below.

3. There is to be no change in the width dimension of the strip workpiece as a result of the drawing operation. As noted before, this requirement dictates that the reduction occasioned by the present invention is not uniformly taken across the entire surface of the workpiece, with the result that the surface to cross sectional area ratio varies by at least 30%, and particularly between 30 and 50%. By surface to cross sectional area ratio is meant the ratio of the surface dimension as determined by the measurement of the perimeter of the strip in relation to the cross sectional area of the strip measured at the same point thereon. This variation distinguishes the preparation of products in accordance with the present invention from multiple gauge processes and products known in the art. Further, the maintenance of substantially the same surface component throughout the drawing operation comprises one of the unexpected aspects of the invention, as the frictional component of the process is not proportionately diminished as with conventional drawing processes wherein all dimensions of the workpiece are simultaneously proportionately reduced. Particularly, the significant reductions in strip cross sectional area render the successful practice of the present method even more surprisingly, as the significantly reduced strip is less capable of coping with the consistently high level of friction exerted through the virtually unchanged surface area.

In addition to defining the particular distinctions and attributes of the products prepared by the above method, the above criteria provide guidelines in determining the drawing angles of the various changes thereof which likewise comprise a salient feature of the present invention. The strip thus formed is free from structural defects and exhibits uniformly close tolerances.

Figure 3:
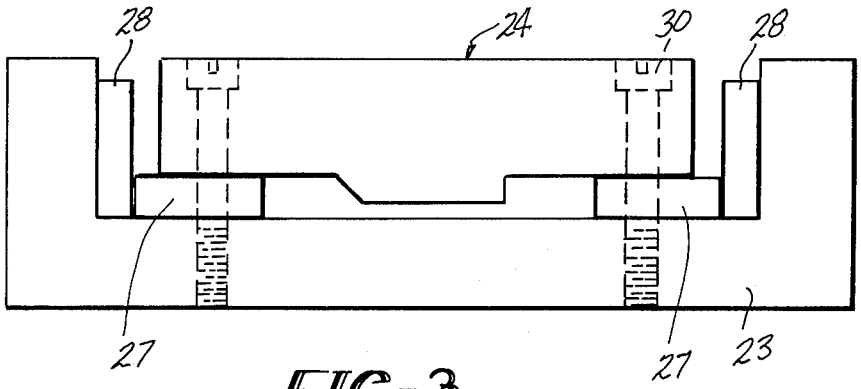
FIG. 3 is a transverse schematic view of the reduction section of the apparatus of this invention.

In order to illustrate the advantages obtained by the practice of the method of this invention, the following tests were conducted to prepare a multiple gauge strip product. The "typical" design chosen for experimental purposes, which is depicted in FIG. 3, includes the large gauge differences in thickness (0.032 and 0.018 inch), a non-symmetrical center channel and 90° and 45° angles on opposite sides of the channel. The following experiments are presented for purposes of illustration only and should not be construed as limitative of the invention.

EXAMPLE I

SINGLE PASS STRIP REDUCTION

In this series of tests, flat rectangular strip (1.203 × 0.096 inches) was contour milled to the configuration illustrated in FIG. 3. The hydrodynamic section of the die assembly consisted of a parallel inlet nozzle of 1 inch in length which has a clearance from strip to nozzle of 0.010 inch. The reduction section comprised a drawing die which defined a drawing angle of 10° for the thick section of the strip and 1° 16 minutes for the thin section. The two sections were sealed together by means of a 0.005 inch thick flat copper sheet gasket which prevented lubricant from leaking out under pressure. Different exit gauges were provided by adjustment of width and height dimensions by the use of spacers and shims of varying thicknesses. Three different exit gauges tested were as follows:

| % Reduction | Gauge Thick Section | Gauge Thin Section |
|---|---|---|
| 20 | 0.082" | 0.046" |
| 27 | 0.067" | 0.038" |
| 39 | 0.048" | 0.027" |

Drawing was conducted at the three gauges set forth above in a single pass in order to determine the feasibility of such a procedure. The results of these tests are set forth in Table I, below.

TABLE I

DATA: SINGLE-PASS DRAWING AT INCREASING REDUCTIONS

| Average Entrance Gauges, in. | | Average Exit Gauges, in. | | Average Volume % Reduction |
|---|---|---|---|---|
| Thick Section | Thin Section | Thick Section | Thin Section | |
| 0.0945 | 0.0570 | 0.0785 | 0.0437 | 20 |
| 0.0945 | 0.0570 | 0.0693 | 0.0408 | 27 |
| 0.0799 | 0.0446 | 0.0489 | 0.0285 | 39 |

From the data presented above, it can be seen that reduction at the respective gauges was both predictable and uniform, and single pass cross sectional reductions of 39% were conducted.

Further experimentation taking into account the theoretical considerations of the absence of friction and compensating work hardening has shown that 55% reduction may be attained and it has been determined from the above results that the maximum single pass reduction lies between 39 and 55% reduction in volume.

EXAMPLE II

REDRAW EXPERIMENTS

Starting stock similar to that employed in Experiment I was subjected to consecutive reductions of 18, 12 and 30%, and measurements were taken for gauge and width variations. The results of these experiments are set forth in Table II, below.

TABLE II

DIMENSIONS AND GAUGE VARIATIONS OF DRAWN STRIP

| Pass No. | Thickness, Inches: Thick Sec. | Thin Sec. | Width, In. | Pass. Red. | Total Red. |
|---|---|---|---|---|---|
| * | 0.0960±0.002 | 0.0540±0.010 | 1.206 | — | — |
| 1 | 0.078±0.0001 | 0.0422±nil | 1.181 | 18% | 18% |
| 2 | 0.0680±0.0003 | 0.0375±0.0003 | 1.180 | 12% | 30% |
| 3 | 0.0472±0.0006 | 0.0263±nil | 1.178 | 30% | 51% |

* Contour milled starting stock

From the above data, it can be seen that gauge variations of the drawn product are less than that of the starting material. Specifically, variations were less than ±0.001 inch, which is much less than the standard tolerance for commercial, rolled strip, which is typically 0.002 inch for this gauge.

EXAMPLE III

SPECIFIC MULTIPLE GAUGE PARTS

Figure 4:
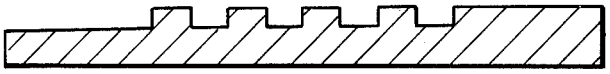
FIGS. 4 and 5 are schematic cross sectional views of multiple guage strip configurations prepared in accordance with the present invention.
Figure 5:
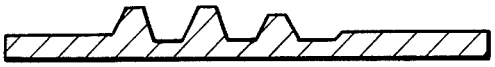

A series of specific parts possessing differing multiple gauge configurations was prepared to further illustrate the drawing process of the invention. The parts were generally given a preliminary shaping by the shaving method disclosed in our aforenoted co-pending application. Most of the parts possessed two basic variations in gauge with the exception of parts 2 and 5, whose configurations are depicted in FIGS. 4 and 5, respectively. Drawing was conducted to approximately a 30% reduction in strip cross sectional area. Measurements were taken of the parts both before and after drawing to record cross sectional perimeters and areas from which ratios representing a comparison of surface to area ($S_L/A$) were determined. The measurements at both starting and final sizes is set forth in Table III, below.

TABLE III

| PART | $S_L$* (in.) START | $S_L$* (in.) FINAL | A** (in.²) START | A** (in.²) FINAL | $S_L/A$ START | $S_L/A$ FINAL | $\Delta S_L/A$*** | $\Delta S_L/A$ (in. %) |
|---|---|---|---|---|---|---|---|---|
| 1 | 2.960 | 2.916 | .045 | .0315 | 65.8 | 92.6 | 26.8/65.8 | 40.7% |
| 2 | 2.575 | 2.400 | .0846 | .0592 | 30.4 | 40.5 | 10.1/30.4 | 33.2% |
| 3 | 3.063 | 3.020 | .0636 | .0445 | 48.2 | 67.8 | 19.6/48.2 | 40.7% |
| 4 | 3.634 | 3.594 | .0911 | .0638 | 39.9 | 56.3 | 16.4/39.9 | 41.1% |
| 5 | 1.400 | 1.352 | .0128 | .009 | 109 | 150 | 41/109 | 37.6% |
| 6 | 2.987 | 2.936 | .0577 | .0404 | 51.7 | 72.7 | 21/51.7 | 40.6% |

*Cross sectional perimeter of part.
**Cross sectional area of part.
*** $\frac{S_L/A \text{ Final} - S_L/A \text{ Start}}{S_L/A \text{ Start}}$ From Table III above, it is apparent that the changes in surface to cross sectional area ratio, represented by $\Delta S_L/A$ (in. %) are within the aforementioned ranges of 30 to 50%. This change is significant and further highlights the achievement of acceptable strip product in accordance with the present method.

In accordance with a further embodiment of this invention, an apparatus for the preparation of multiple guage metal strip by hydrodynamic drawing is disclosed which comprises a die assembly of modular construction which is easily adaptable to changes of size and/or shape of the product desired.

Referring again to FIG. 1, the apparatus of this invention is schematically depicted in gross. Thus, container 12 housing a quantity of lubricant 13 is shown in linear alignment with hydrodynamic section 17 such that strip 10 may pass through openings 14 and 15 and into the inlet nozzle comprising hydrodynamic section 17. In accordance with an alternative embodiment of this invention, hydrodynamic section 17 is illustrated as detachably connected to reduction section 18, however, it is contemplated that both sections may be combined in a unitary structure. The connection between hydrodynamic section 17 and reduction section 18 is rendered leak-proof by seal member 20 which may comprise a 0.005 inch thick flat copper sheet gasket. Both hydrodynamic section 17 and reduction section 18 are comprised of a primary shape-defining element and a secondary shape-defining element. In hydrodynamic section 17 primary nozzle element 21 comprises the base of the nozzle and secondary nozzle element 22 comprises the top which is fastened thereto. Likewise, reduction section 18 is comprised of primary die element 23 which serves as the base of the die, and secondary die element 24 attached thereto.

Figure 2:
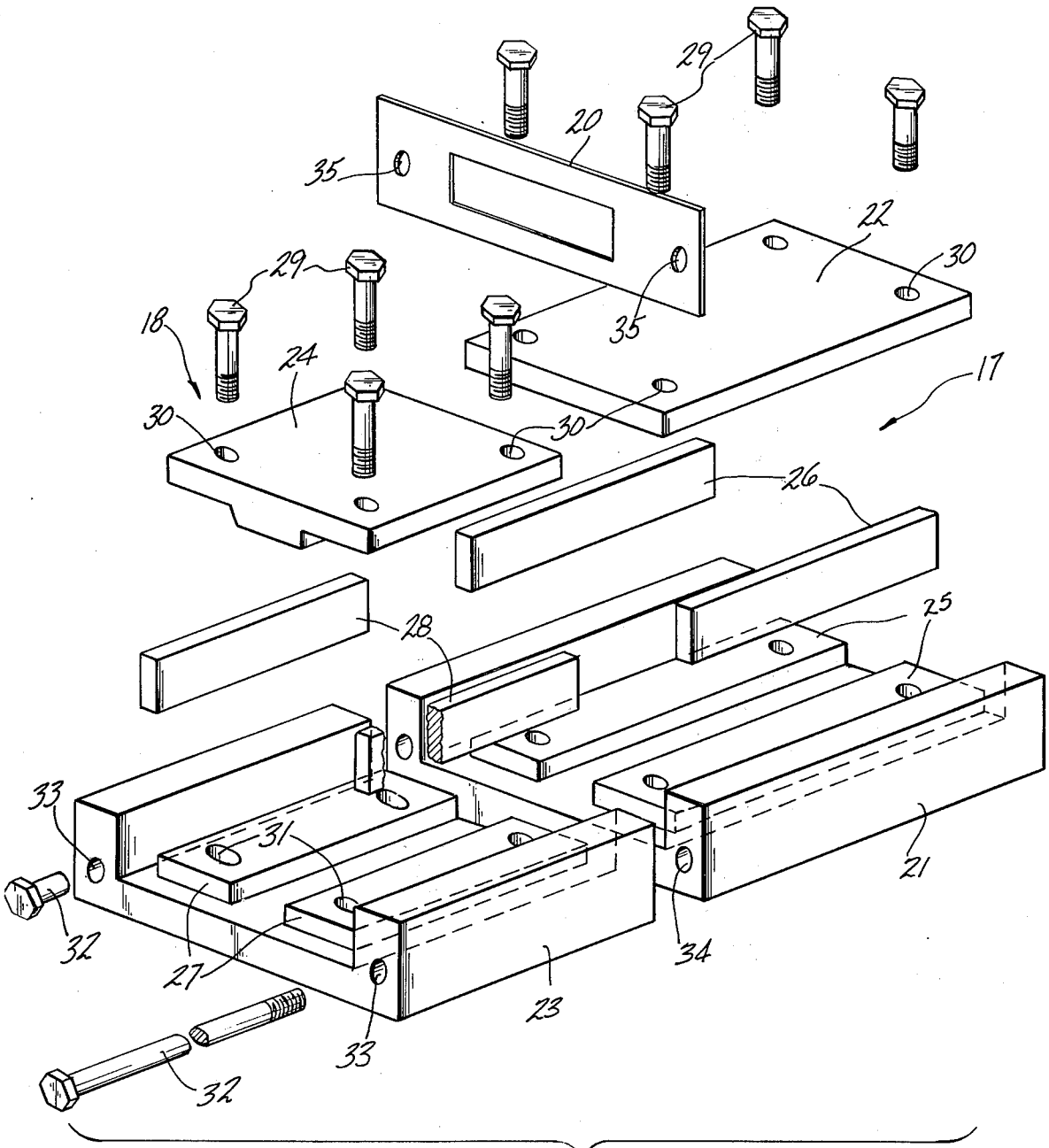
FIG. 2 is an exploded view in perspective illustrating the apparatus of this invention.

In addition to the primary and secondary shape-defining elements comprising the die assembly, means are provided for adjusting the height and width dimensions of the cross sectional area defined by said elements. Referring now to FIG. 2, there is depicted an exploded view in perspective detailing the die assembly of FIG. 1. It can be seen that certain structures are employed between primary elements 21 and 23 and secondary elements 22 and 24 of respective sections 17 and 18. The element providing adjustment for the height dimension consists of paired spacers, labeled 25 in hydrodynamic section 17, and 27 in reduction section 18. Spacers 25 are normally parallel-surfaced in hydrodynamic section 17, as strip reduction is not conducted therein. Spacers 27, however, are slightly tapered on their horizontal surfaces so as to communicate with the corresponding tapers of elements 23 and 24 of reduction section 18. Spacers 25 and 27 may vary in thickness to provide the corresponding adjustment of the height dimension.

The adjustment of the width dimension is provided by paired shims labeled 26 in hydrodynamic section 17, and 28 in reduction section 18. Referring now to FIG. 3, it can be seen that the shims are placed laterally between the spacers, labeled here 27, and primary shape-defining element 23.

As illustrated in both FIGS. 2 and 3, both sections of the die assembly of this invention are fastened together by means of bolts 29 which pass through holes 30 specially provided there for anchoring them in the primary shape-defining elements. Both spacers 25 and 27 are provided with specially widened adjustable holes 31 which permit lateral movement while the bolts are engaged but not tightened, so as to provide for adjustments in width dictated by variations in the size of the shims employed.

The two sections of the die assembly of FIGS. 1 and 2 are fastened together by means of bolts 32 which pass through holes 33 placed in major shape-defining element 23 and anchor in holes 34 provided in shape defining element 21. Corresponding holes are provided in sealing member 20 for the passage therethrough of the bolts.

The above description of the apparatus and corresponding figures are merely illustrative of one form of die configuration and assembly, and does not constitute the sole embodiment thereof, as variations in size, shape and assembly of parts may be employed by those skilled in the art within the scope of this invention. Likewise, the apparatus of this invention may be constructed from a wide variety of materials known to be suitable by those skilled in the art.

The products of the present invention possess a distinctive surface texture which is matte-like in appearance and therefore non-reflective though uniform. This surface texture is the result of the employment of hydrodynamic lubrication, in that the pocketing of the high viscosity lubricant tends to generate minor depressions. The product thus bears no resemblance to the burnished surface resulting from conventional metal working processes.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. A method for the preparation of multiple gauge metal strip of rectangular cross section possessing regions of at least two variable thicknesses defining a stepped surface configuration in at least one of the broad surfaces of said strip, said method comprising, drawing a previously shaped strip through a die defining said rectangular cross section wherein direct surface-to-surface contact between said strip and said die is prevented, the width dimension of said strip is unchanged and the ratio of strip perimeter to strip cross sectional area changes by at least 30%.

2. The method of claim 1 wherein said previously shaped strip possesses a multiple gauge configuration corresponding to the configuration of said die.

3. The method of claim 1 wherein said strip undergoes reduction taken on the broad surfaces thereof.

4. The method of claim 1 wherein said change of the ratio of strip surface to strip cross sectional area comprises an increase.

5. The method of claim 4 wherein said ratio changes by an amount ranging from 30 to 50%.

6. The method of claim 1 wherein said drawing employs hydrodynamic lubrication and achieves one pass cross sectional reductions ranging from 39 to 55%.

7. The method of claim 1 wherein said strip is previously shaped by a milling operation.

8. The method of claim 1 wherein said strip is previously shaped by a shaving operation.

9. The method of claim 1 wherein said multiple gauge configuration comprises three truncated pyramidal protrusions in the central region of one broad surface of said strip.

10. The method of claim 1 wherein said multiple gauge configuration comprises four rectangular grooves located in the central region of one broad surface of said strip.

11. The method of claim 1 wherein said multiple gauge configuration comprises a stepped reduction in gauge defining two levels of the broad surfaces of said strip, said reduction occurring at parallel points on each of said surfaces.

12. The method of claim 1 wherein said multiple guage configuration comprises a non-symmetrical center channel disposed on one broad surface of said strip, said channel defining, respectively, 90° and 45° angles on opposite sides thereof.

13. A method for the preparation of multiple gauge metal strip which comprises shaping strip material of rectangular cross section to form regions of at least two variable thicknesses defining a stepped surface configuration in at least one of the broad surfaces of said strip material, and drawing the shaped strip material through a die employing hydrodynamically lubricated die which defines said stepped surface configuration to cause a reduction in the thickness of said strip to final dimension, wherein said drawing is performed without direct surface-to-surface contact between said strip and said die, the width dimension of said strip is unchanged and the ratio of strip perimeter to strip cross sectional area changes by at least 30%.

14. The method of claim 13 wherein said strip material is shaped by a shaving operation.

15. The method of claim 13 wherein said ratio change comprises an increase.

16. The method of claim 13 wherein one pass cross sectional reductions of from 39 to 55% are conducted.

17. An apparatus for the preparation of multiple gauge metal strip of rectangular cross section possessing regions of at least two variable thicknesses defining a stepped surface configuration by hydrodynamic drawing which comprises:

A. a container which houses a quantity of lubricant material and possesses an opening in its side walls for the passage therethrough of metal strip; and B. a die assembly mounted adjacent said container in communication with one of said openings which defines a multiple gauge cross sectional configuration and which comprises a hydrodynamic section and a reduction section connected thereto, wherein said reduction section is of such configuration that strip reduction is confined to the broad surfaces of said strip, and equal percentage reductions of said strip occur uniformly with respect to said variable thicknesses at any point lying within any given transverse plane taken therethrough.

18. The apparatus of claim 17 wherein each section of said die assembly is comprised of a primary shape-defining element, a secondary shape-defining element and means for adjusting the height and width dimensions of the cross sectional area defined by said elements.

19. The apparatus of claim 18 wherein said adjusting means comprises paired spacers of varying thickness which are located between said shape-defining elements to adjust said height dimension.

20. The apparatus of claim 19 wherein said adjusting means further comprises paired shims of varying thickness which are laterally located between said spacers and said primary shape-defining elements to adjust said width dimension.

21. The apparatus of claim 17 wherein said hydrodynamic section comprises an adjustable inlet nozzle defining a cross sectional area of sufficient size to enable the passage therethrough of lubricant-coated metal strip.

22. The apparatus of claim 17 wherein the reduction section comprises an adjustable drawing die defining said multiple gauge cross sectional configuration.

23. The apparatus of claim 17 wherein the connection between said hydrodynamic section and said reduction section is detachable.

24. The apparatus of claim 23 wherein said detachable connection is rendered leak-proof by the provision of a seal member between the mating surface of said die and said nozzle.

* * * * *